United States Patent [19]

Symington

[11] Patent Number: 4,800,804

[45] Date of Patent: Jan. 31, 1989

[54] VARIABLE AIR FLOW DIFFUSER

[75] Inventor: Laurence I. Symington, Unicoi, Tenn.

[73] Assignee: Tennessee Plastics, Inc., Johnson City, Tenn.

[21] Appl. No.: 82,350

[22] Filed: Aug. 6, 1987

[51] Int. Cl.[4] ..... F24F 11/00; F24F 13/062

[52] U.S. Cl. ..... 98/40.06; 98/41.2; 137/73; 137/80; 251/249.5

[58] Field of Search ..... 98/1, 40.06, 40.15, 98/40.16, 40.09, 40.22, 41.2; 137/72, 73, 74, 75, 79, 80; 251/129.04, 249.5, 318, 319, 339

[56] References Cited

U.S. PATENT DOCUMENTS

| | | | |
|---|---|---|---|
| 432,744 | 7/1890 | Adams | 251/318 |
| 3,289,686 | 12/1966 | Tyler, Jr. | 137/73 |
| 4,181,253 | 1/1980 | Barlow | 98/40.15 X |
| 4,338,961 | 7/1982 | Karpenko | 251/249.5 X |
| 4,488,566 | 12/1984 | Hicks | 137/74 |

FOREIGN PATENT DOCUMENTS

| | | | |
|---|---|---|---|
| 572765 | 3/1959 | Canada | 98/41.2 |
| 54725 | 11/1891 | Fed. Rep. of Germany | 98/41.2 |

*Primary Examiner*—Harold Joyce

[57] ABSTRACT

An air diffuser adapted for mounting in a building for controlling air pressure within a space, the diffuser comprising a tile such as can be placed in a ceiling and having an air inlet side and an air discharge side, a wall providing an air flow port in the tile for allowing the flow of air from the inlet side to the discharge side, a damper adapted in one position to substantially seal against the wall adjacent the port to prevent air flow through the port, and in other positions removed from the wall to allow variable air flow through the port, an electrically operated actuator connected to the building and/or the tile, and to the damper for moving the damper toward or away from the wall, guide posts on the tile extending generally axially of the direction of movement of the damper toward and away from the wall, and follower apertures in the damper slidable over the guide posts to allow substantially only linear movement of the damper. A temperature and/or smoke sensor is preferably positoned on the tile and/or the damper for communication with at least one side of the tile, and an electrical circuit is connected to the sensor and the actuator and adapted to energize the actuator to move the damper toward or away from the wall adjacent the port at predetermined temperature and/or smoke levels existing on at least one side of the tile.

9 Claims, 7 Drawing Sheets

DIP SWITCH

WIRING DIAGRAM

VARIABLE AIR FLOW DIFFUSER

This invention concerns the regulation of air flow into or out of an area, and thus, the pressure within that area, and particularly concerns a novel mechanism, hereinafter termed "diffuser", for use in controlling the air flow in response to automatic or manual actuation, primarily in response to air temperature and/or smoke concentration within the area as detected and evaluated by electronic sensors and related equipment.

Considerable study within the building and architectural fields is presently being applied to the problem of how to detect and quickly act in situations where fire breaks out in an area which is not immediately visible, i.e., little or no occupancy at the time, and particularly where the fire is producing great quantities of smoke. As is well known, one of the greatest dangers of building fires is the smoke which not only reduces visibility and prevents escape or rescue but which in itself is lethal.

As air flow control device which, in a general sense can function somewhat similarly to the present diffuser but which is constructed quite differently in a much more complex manner is shown in U.S. Pat. No. 4,509,678. The air flow control device of this patent requires elaborate supporting structures and mechanical linkages, is not amenable to activation by electronic smoke or heat sensing, and does not suggest any direct action damper movement in response to such sensing.

The present invention has as its principal objective therefore, to provide an electro-mechanical device which can be used with sophisticated electronic equipment to control air flow in cooperation with means for automatically sensing excessive temperatures and/or smoke within an unoccupied fire area, and automatically acting to control air flow into or out of that area. Such control will produce a pressure profile within the fire area with respect to other contiguous areas whereby the smoke will tend to be contained within the fire area or at least to allow more time for evacuation of the contiguous areas before the smoke therein becomes a serious problem.

This and other objectives hereinafter appearing has been attained in accordance with the present invention through the discovery of air diffuser construction adapted for mounting in a building, particularly in the ceilings of rooms, halls or storage spaces, wherein said diffuser comprises tile means having an air inlet side and an air discharge side, wall means providing port means in said tile means for allowing the flow of air from said inlet side to said discharge side, damper means adapted in one position to substantially seal against said wall means to prevent air flow through said port means and in other positions removed from said wall means to allow variable air flow through said port means, electrically operable actuator means having relatively movable elements, one of said elements being connected to said building and/or a non-rotatable portion of said diffuser, and the other of said elements being connected to said damper means whereby relative motion between said elements will move said damper means toward or away from said wall means to adjust the flow of air through said port means, guide means on said diffuser comprising a plurality of posts extending generally axially of the direction of movement of said damper means toward and away from said wall means, and follower means on said damper means engageable with said guide means to allow substantially only linear movement of said damper means.

In a particularly preferred embodiment of the invention, the diffuser in controlled by temperature and/or smoke sensor means positioned on the diffuser in communication with at least one side of the tile means, and electrical circuit means connected to the sensor means and the actuator means of the diffuser and adapted to energize the actuator means to move the damper means toward or away from the wall means at predetermined temperature and/or smoke levels existing on at least one side of the tile means.

In other preferred embodiments of the invention:

(a) the guide means comprises a plurality of guide rods affixed to said tile means at positions spaced from each other around and adjacent the periphery of said port means and extending substantially perpendicularly from the plane of said tile means outwardly on said discharge side, and the follower means comprises a plurality of guide apertures at positions spaced from each other around the periphery of said damper means and adapted to slidably receive said guide rods for allowing only substantially linear sliding motion of said damper means on said guide rods;

(b) the actuator means comprises screw shaft and nut elements wherein either one of said elements is electrically driven, and the elements are interchangeably affixed to the tile and damper means;

(c) the nut element of the actuator means comprises the output of a gear reduction unit of an electrical motor which is stationary on either the tile means or the damper means;

(d) the tile means is provided with a support disc affixed to the outer ends of the guide rods, and the sensor means is mounted on said disc;

(e) the support disc is provided with a trim disc, and the support disc and trim disc are shaped to provide in combination an enclosed chamber for containing the sensor means; and (f) spring means is provided for engaging a stationary portion of the diffuser and said damper means for moving said damper means toward the port means in response to a fail- safe signal such as excessively high temperature conditions on the discharge side of the tile means.

The invention will be understood further from the following description and drawings wherein.

Figure 1:
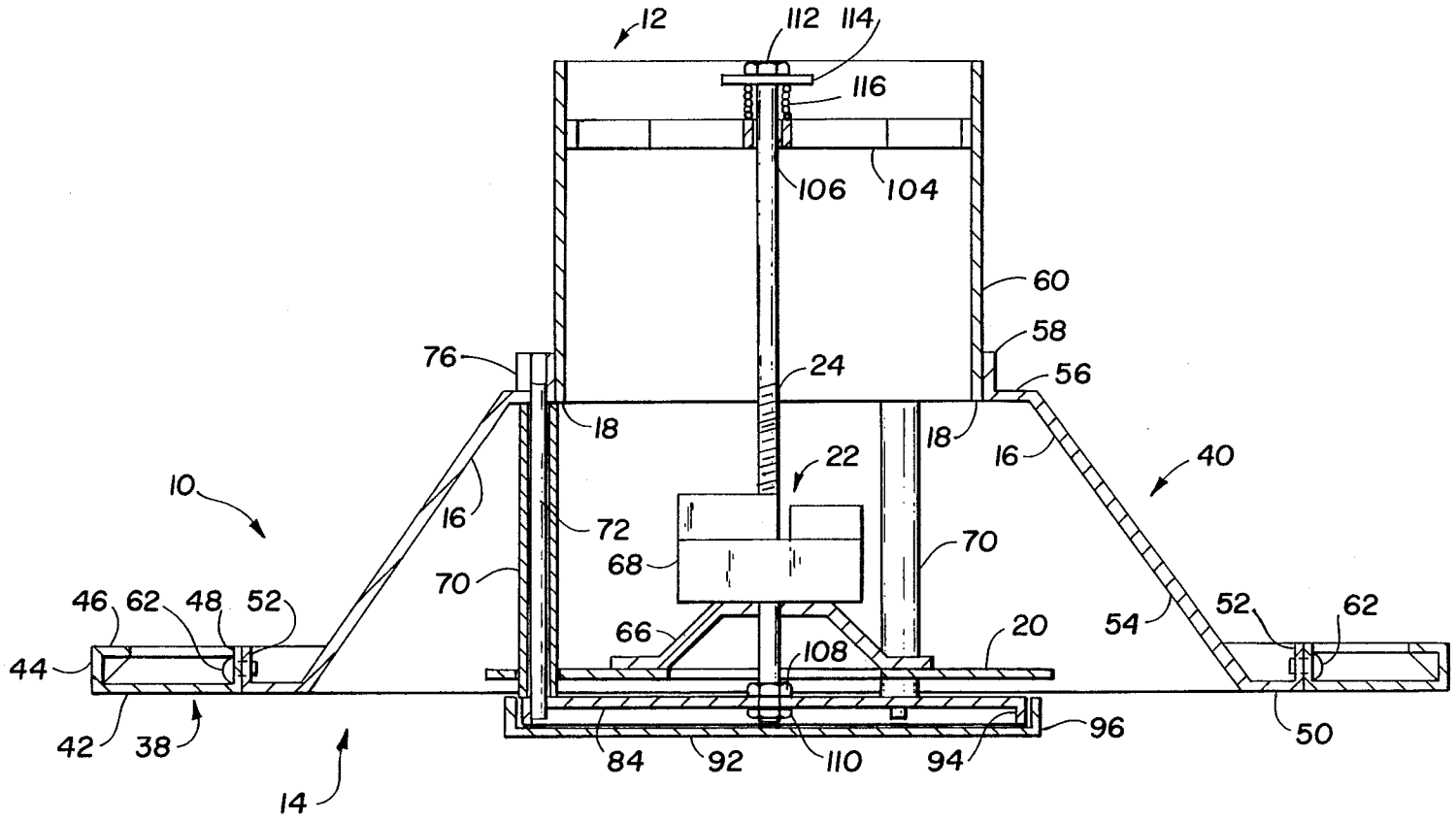
FIG. 1 is a side view of the diffuser typically mounted in a ceiling, with portions broken away.
Figure 3:
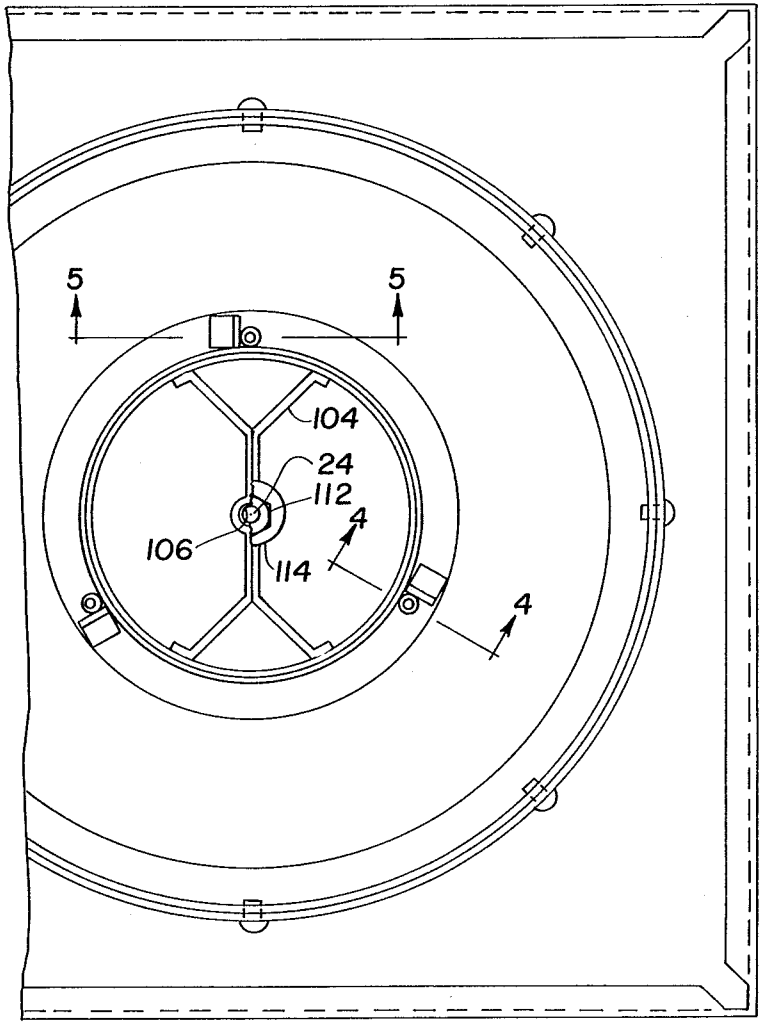
FIG. 3 is a top view of the diffuser.
Figure 2:
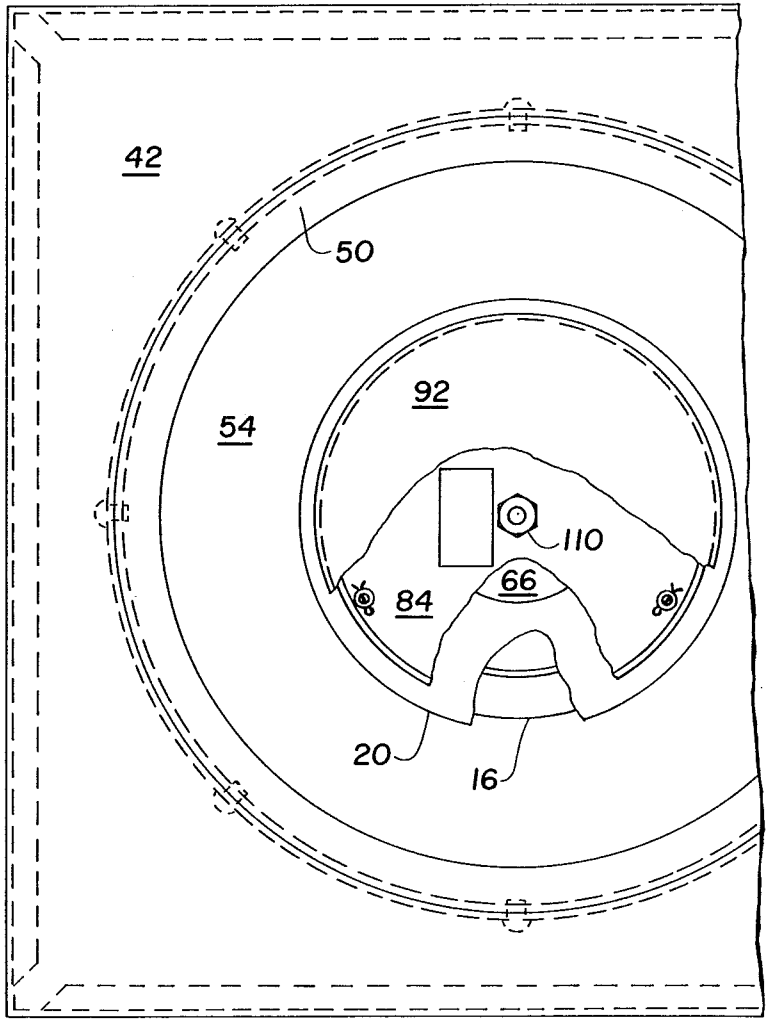
FIG. 2 is a bottom view of the diffuser with portions broken away.
Figure 5:
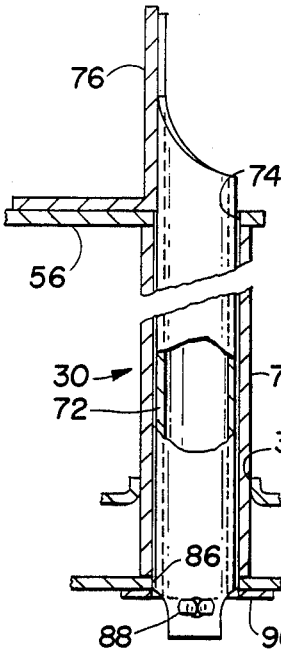
FIG. 5 is a side view of the guide means and its attachments, taken along line 5—5 of FIG. 3 in the direction of the arrows with the guide rods shown principally in elevation.
Figure 4:
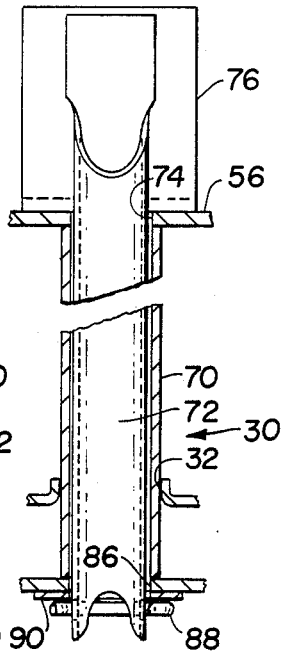
FIG. 4 is a side view of the guide means and its attachments, taken along line 4—4 of FIG. 3 in the direction of the arrows with the guide rods shown principally in elevation.

Referring to the drawings, the diffuser construction, with reference to its broad definition given above, comprises tile means or a base generally designated 10, which can be dimensioned and adapted, for example, to replace a typical square tile of a ceiling, having an air inlet or supply side 12 and an air discharge or damper side 14, wall means 16 providing port means 18 in said tile means 10 for allowing the flow of air from said inlet side 12 to said discharge side 14, damper means 20 adapted in one position to substantially seal against said wall means 16 to prevent air flow through said port means 18 and in other positions removed from said wall means 16 as shown, for example in FIG. 1, to allow variable air flow through said port means 18, electrically operable actuator means generally designated 22 having (A) a non-rotatable threaded screw shaft 24 connected to said damper means, (B) a rotatable nut means 26 threadably receiving said shaft and adapted to move the same longitudinally, and (C) a stationary housing 28 for said nut means 26 affixed to said damper means 20, said actuator means being actuable to rotate said nut means and move said damper means toward or away from said wall means 16, guide means generally designated 30 affixed to said tile means and extending generally axially of the direction of movement of said damper means 20 toward and away from said wall means 16, and follower means 32 on said damper means engageable with said guide means to allow substantially only linear movement of said damper means along said guide means.

Any types of temperature and/or smoke sensor means 34 may be mounted on the tile means and/or the damper means, or in any other functional location on the building wherein it is in communication with at least one side of the tile means, and any electrical circuit means 36 may be connected to the sensor means and the actuator means for energizing the actuator means to move the damper means toward or away from the wall means 16 according to any predetermined program which reflects temperature and/or smoke levels existing on at least one side of the tile means.

Figure 7:
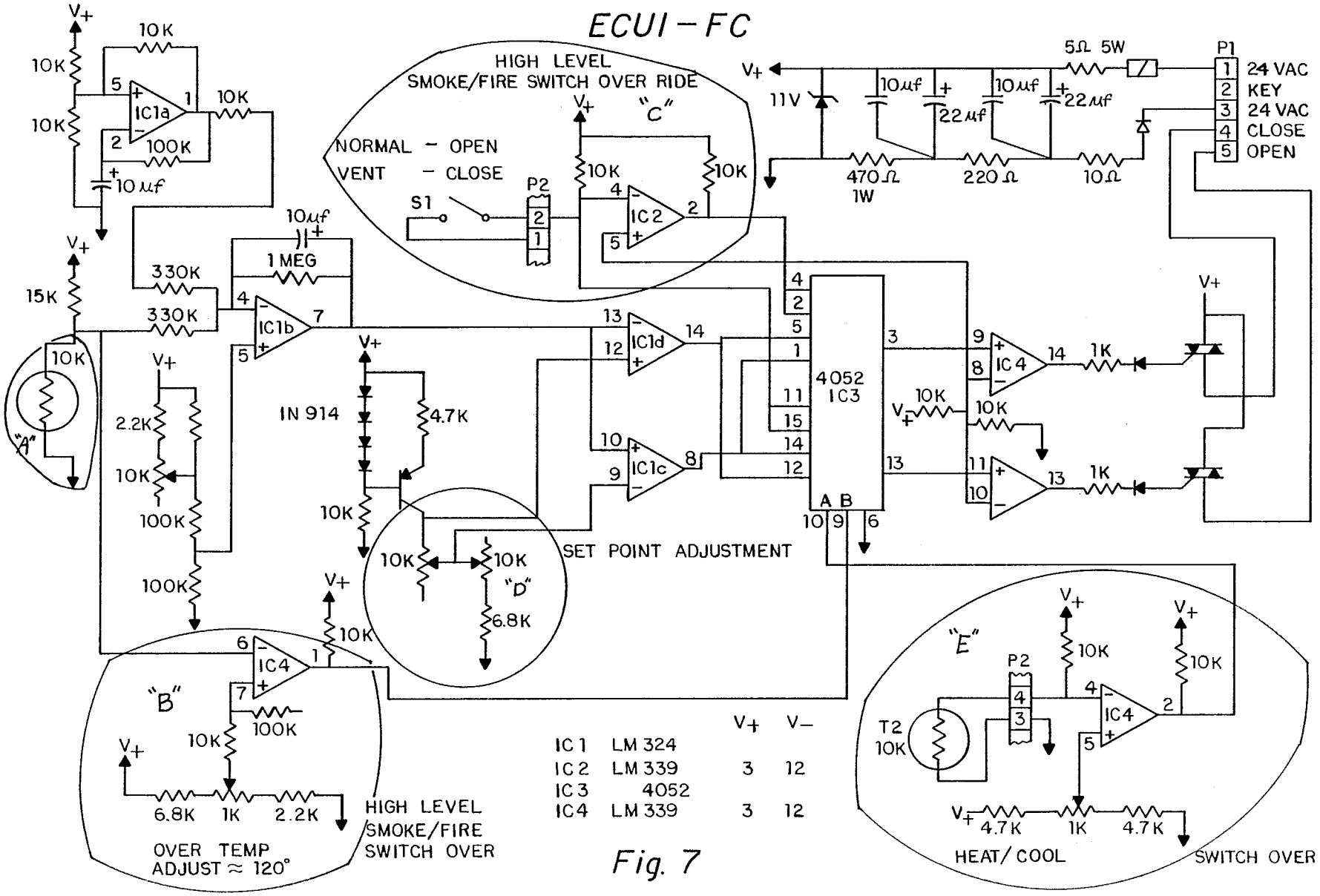
FIG. 7 is an electrical circuit for controlling the present diffuser.

The variety of predetermined conditions of temperature and/or smoke to which the sensor and electrical circuit means can be made to respond to essentially infinite and the electrical circuit shown herein in FIG. 7 is exemplary only. Virtually any type of program for the actuator can be provided, including sophisticated computerized programs, for moving the damper means to any desired position with respect to the port means in response any temperature and/or smoke conditions.

In the particular exemplary structure of the diffuser components shown and described herein, the tile means 10 comprises a base section generally designated 38 and throat section generally designated 40. The base section is in the general peripheral shape of a flat, square plate 42 having an upturned outer rim 44, inwardly turned lip 46, and has an upturned inner rim 48 of substantially circular shape. The throat section 40 comprises a substantially circular web 50 provided with an outer upturned rim 52 and an inner wall 54 of a frusto-conical configuration which forms the wall means 16 and which is provided with an outer shoulder 56, adaptor rim 58 and flue section 60. Rims 48 and 52 of the base section and throat section respectively are conveniently attached by rivets 62 or other equivalent means to form a substantially air-tight seal between the two sections.

The damper means 20 is formed as a disc such that its periphery 64 can be positioned uniformly adjacent conical wall 16 to restrict, to any desired degree, the air flow through port 18. This disc is formed preferably with an arch 66, mainly for strength, to which the housing 68 of the actuator means 22 is attached. This damper, as aforesaid, is provided with follower means 32 comprised of apertures through which the guide means slidably pass. The guide means 30 preferably consist of outer bushings or spacers 70 which are slid over tubular posts 72 which are secured in outer shoulder 56 by passing tightly through apertures 74 therein and fastened by spot welding or the like to "L" shaped brackets 76 spot welded to the upper surface of shoulder 56. These bushings 70 maintain and rigidify the diffuser elements in proper relative positions. The preferred material for essentially all of the components of the present diffuser is sheet metal.

Figure 11:
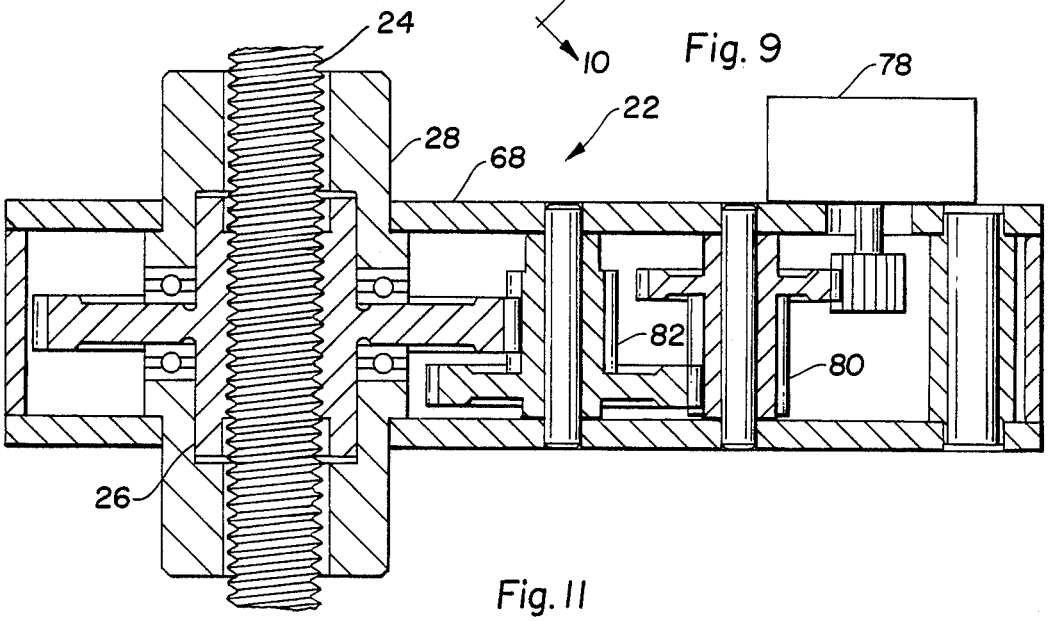
FIG. 11 is a cross-sectional view of a typical gear reduction unit useful as an actuator means.
Figure 6:
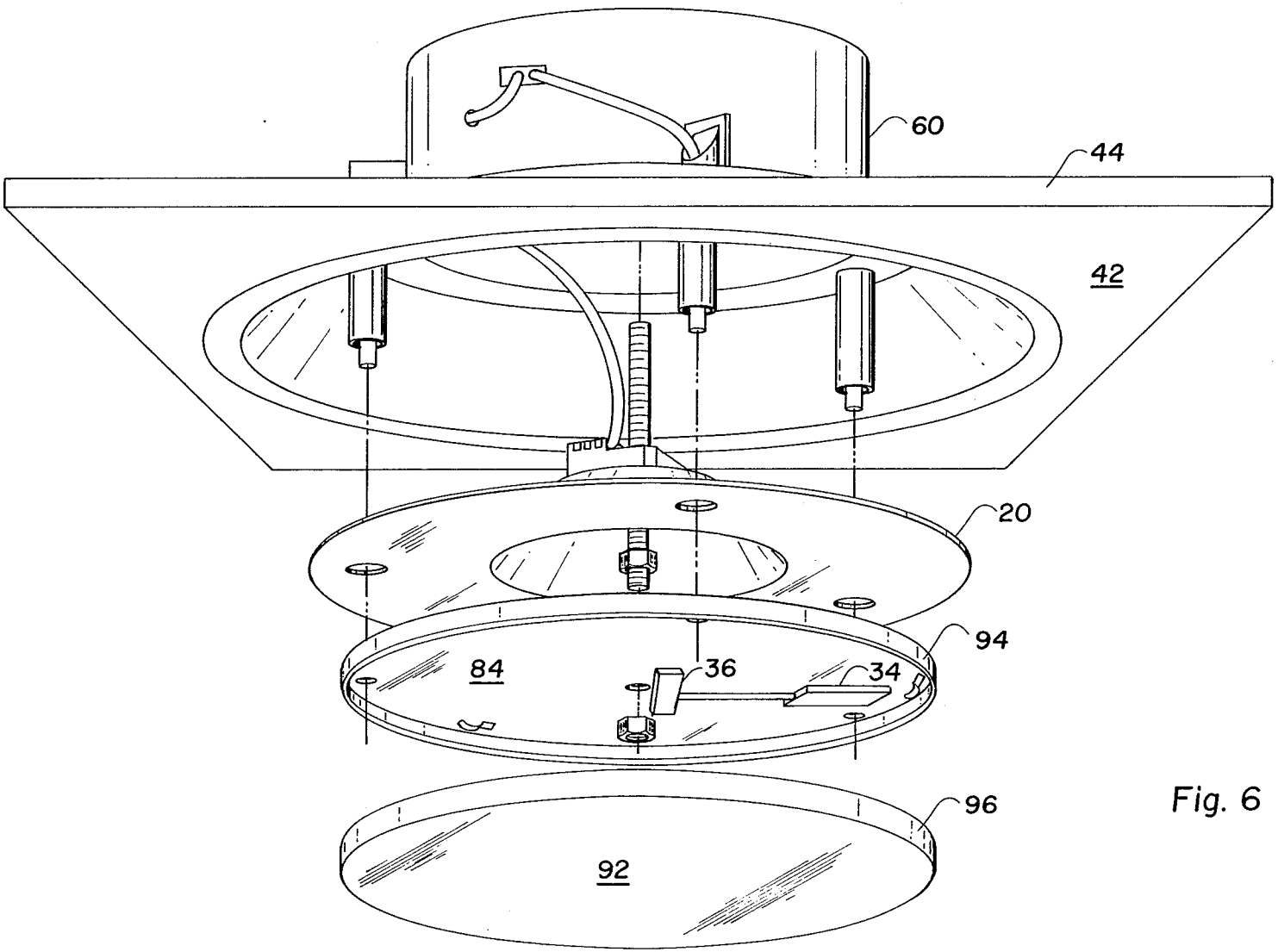
FIG. 6 is a perspective view, exploded, of the diffuser.

Referring to FIG. 11, a typical actuator means 22 is shown as comprising an electric motor 78, reduction gears 80 and 82 which drive a gear type, and internally threaded nut 26 to move shaft 24 in a linear motion. This type of actuator is conventional and the particular one shown in the drawings is a "SCS- mini push linear drive actuator A1L150" of Staefa Control System, as described in the accompanying data sheet of SCS-USA.

Figure 10:
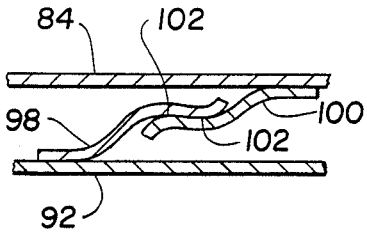
FIG. 10 is a cross-sectional view of both the support disc and the trim disc taken along line 10—10 of FIG. 9 in the direction of the arrows showing the friction clips engaged.
Figure 9:
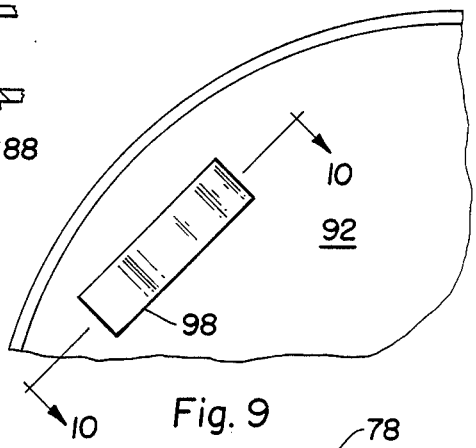
FIG. 9 is an elevation of a portion of the trim disc viewed downwardly in FIG. 1 showing a friction clip.

In preferred embodiments of the invention a support disc 84 is attached to the guide posts 72 adjacent their outer ends by any suitable means such as by passing through apertures 86 in the support disc and retained therein by cotter pins 88 or the like. Washers 90 may be provided. As aforesaid, bushings 70 actually form the guide surfaces of the guide means and provide greater stability to the overall diffuser as well as providing a preferred, positive means for precisely positioning the temperature and/or smoke sensor thereon. A trim disc 92 preferably is provided to protect the sensor, and either or both of the support disc and the trim disc are formed with rims such as 94 and 96 to provide a suitable cavity for the sensor. Referring to FIGS. 9 and 10, the trim disc is conveniently secured in place by suitable friction type assembly clips such as 98 and 100 secured to the discs and provided with shoulders 102 which snap over each other as the trim disc is rotated relative to the support disc. Other convenient attaching mechanisms may of course by employed.

The flue section 60 is secured by spot welding or the like to adaptor rim 58 and is provided with a spider shaped bracket 104 secured to the inner wall of the flue segment by spot welding or the like, which bracket is formed to provide an aperture 106 to slidably receive the upper end of the threaded actuator or screw shaft 24. This shaft is threadedly mounted in the rotatable nut 26 of the gear reduction unit, and its lower end is fastened to the support disc, preferably by steel nut 108 and heat fusible nut 110 or equivalent fusible means. The upper end of shaft 24 is preferably provided with a nut 112 and washer 114 or other suitable means for retaining in compressed condition a spring 116. This spring, when excessive heat melts fusible nut 110, will rapidly drive damper 20 against wall 16 and prevent further air flow through port 18 in the event the temperature in the room reaches the fusion temperature of the nut 110 or an equivalent fusible link. This structure affords a fail-safe mechanism for situations, for example, where the temperature sensor becomes damaged and is allowing air to flow into a room and further feed the fire.

A typical electrical or electronic circuit which is designed to control the present diffuser is shown in FIG. 7 wherein the electronic control unit 36 is positioned between the support and trim discs. Referring to FIG. 7, the encircled portions (A) through (E) represent a novel electrical circuitry especially useful in the present invention.

(A) This is an electronic sensor and when attached to the trim disc senses the temperature of the metal of the trim disc. Because of the natural air flow of the room air over the outer surface of this disc, the sensor reflects an accurate reading of the room air temperature.

(B) In the event of the room air temperature becoming abnormally high, this circuitry will by-pass the normal control of the controller to reverse the reaction of the sensor (A) and activate the motor to move the damper from the open to the fully closed position.

(C) This circuitry is provided for the remote reopening of the damper against the control of (B). If the fire in the trouble area is brought under control, this remote switching is provided for use by an authorized person to open the damper to let fresh air in to drive the smoke out.

(D) This circuitry is provided for the adjustment of the control set point governing the sensor in (A). This circuitry is readily connectable to a remote control computer unit.

(E) This circuitry is provided for switching over of the control from cooling to heating, and senses the supply air temperature.

Figure 8:
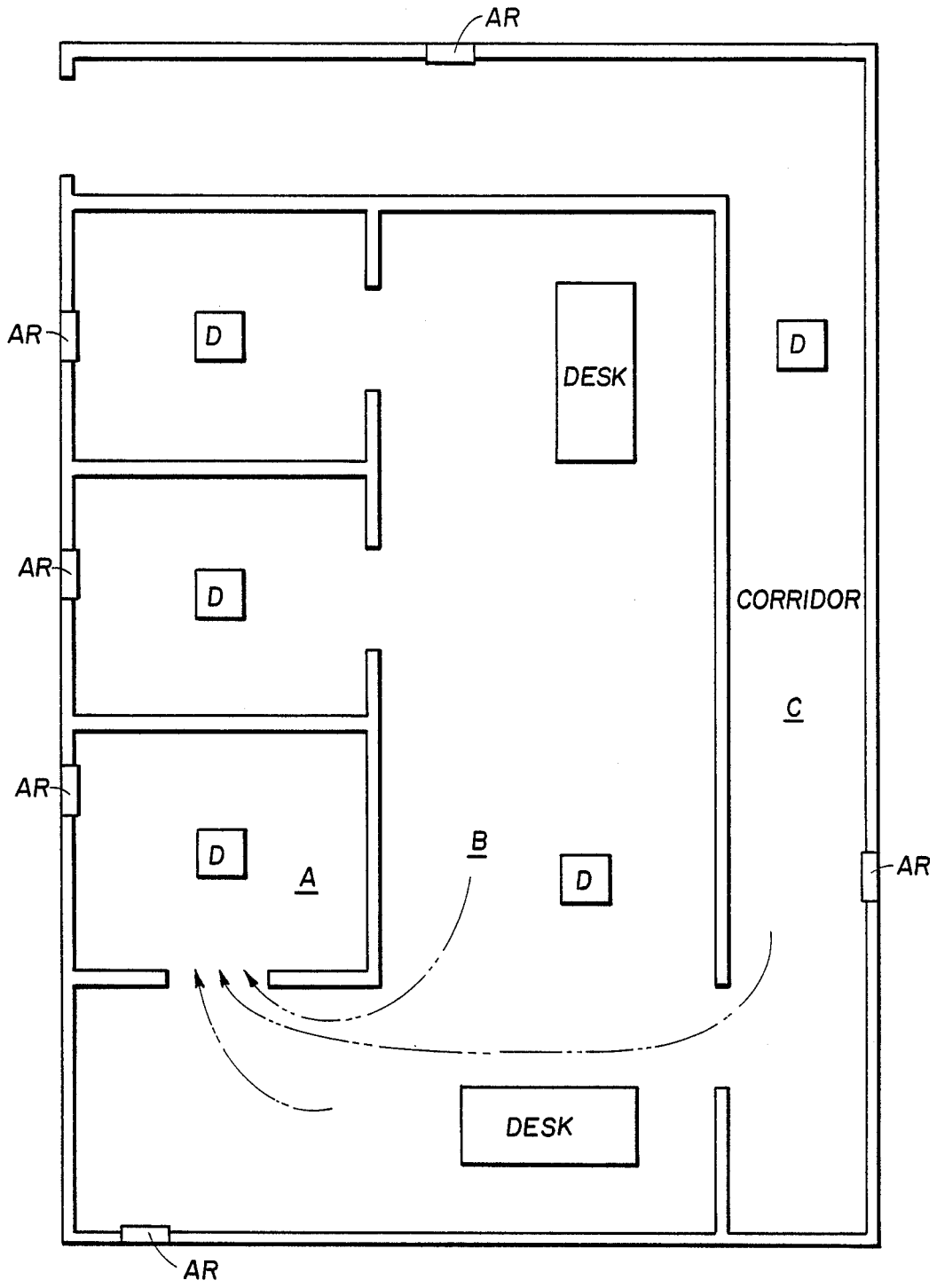
FIG. 8 is a typical floor plan of rooms of such as in an office arrangement in which the present device is particularly useful.

With reference to FIG. 8 wherein a typical office plan is shown with several of the present diffusers D in place in the ceiling, in the event the air temperature or smoke level in area A becomes abnormally high, the electronic sensor would detect such condition and electronically actuate the electrical motor to drive the damper closed. With the inlet air flow cut off in area A, and the air return vent "AR" remaining open, the area would become a slightly negative pressure zone and the smoke would be contained therein due to the natural movement of air from areas B and C, as shown by the dotted lines. The air in area B should be relatively unaffected by smoke and give the occupants a shorter distance and greater time to travel to a safe area.

ELECTRONIC CONTROL UNIT 1—FIRE CONTROL

1. GENERAL DESCRIPTION

This specification describes the ECU1-FC. It is a state of the art electronic temperature control to be used in a variable ceiling diffuser for a cooling only system. The ECU-1-FC also provides fire control by closing the diffuser if the temperature of the sensor is greater than 120° F.

2. CIRCUIT DESCRIPTION

The ECU1-FC is a single PC board that mounts inside the cover of the variable ceiling diffuser. A linear drive acuator is controlled by the ECU1-FC to drive the damper in the diffuser to regulate the zone temperarture. The temperature is monitored by a sensor attached to the board and held in contact with the front cover of the diffuser.

Figure 12:
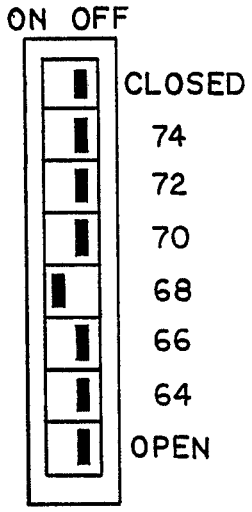
FIG. 12 is a view of the switches for controlling the damper.

A miniature eight position switch (dip switch) is used to set the ECU1-FC (see FIG. 12). Six positions are used to set the temperature from 64° F. to 74° F. The other two position are used to open or close the damper regardless of the temperature. If either of these two switch positions are on, the ECU1-FC does not operate automatically.

If the temperature reaches 120° F. the ECU1-FC will drive the damper to the closed position to provide fire control. When the temperature drops below 115° F. the damper will automatically open. The damper can also be opened by the OPEN position of the switch. Only one of these switches should in the on position at any time.

Figure 13:
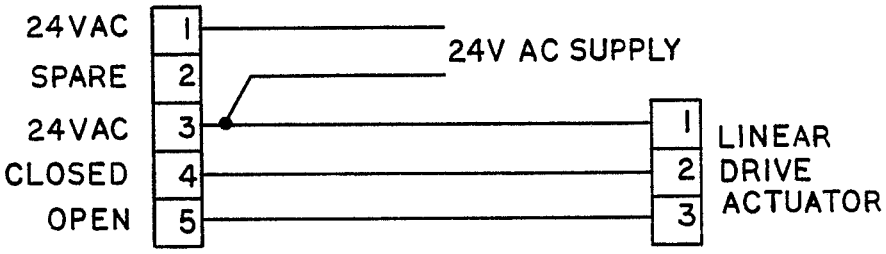
FIG. 13 is an exemplary wiring schematic for the actuating mechanism for the damper.

The ECU1-FC operates from a normal 24 volt AC supply. It supplies the power to the linear drive acuator. See FIGS. 13 for the wiring diagram.

3. OPERATING PARAMETERS

For normal operating conditions the ECU1-FC has the following specifications:

TEMPERATURE CONTROL RANGE: 64°-74° F.

FIRE CONTROL TEMPERATURE: 120° F.

POWER REQUIREMENTS: 24 VOLTS AC+20%, −10%; >0.15 AMP [ECU1-FC+actuator]

The invention has been described in detail with particular reference to preferred embodiments thereof, but it will be understood that variations and modifications will be effected within the spirit and scope of the invention.

I claim:

1. An air diffuser adapted for mounting in a building, comprising tile means having an air inlet side and an air discharge side, wall means providing port means in said tile means for allowing the flow of air from said inlet side to said discharge side, damper means adapted in one position to substantially seal against said wall means to prevent air flow through said port means and in other positions removed from said wall means to allow variable air flow through said port means, electrically driven actuator means having relatively movable elements, one of said elements being connected to a stationary portion of said diffuser, and the other of said elements being connected to said damper means whereby relative motion between said elements will move said damper means toward or away from said wall means to adjust the flow of air through said port means, guide means on said diffuser comprising a plurality of guide posts extending generally axially of the direction of movement of said damper means toward and away from said wall means, and follower means on said damper means engageable with said guide means to allow substantially only linear movement of said damper means.

2. The diffuser of claim 1 wherein temperature or smoke sensor means is provided on said diffuser in communication with at least one side of said tile means, and electrical circuit means is connected to said sensor means and said actuator means and adapted to energize said actuator means to move said damper means toward or away from said wall means at predetermined temperature or smoke levels existing on at least one side of said tile means.

3. The diffuser of claim 1 wherein the guide posts are affixed to one side of said tile means at positions displaced from each other around the periphery of said port means and extending substantially normally from the plane of said tile means, and the follower means comprises a plurality of guide apertures at positions displaced from each other around the periphery of said damper means and adapted to slidably receive said guide posts for allowing only substantially linear sliding motion of said damper means on said guide posts.

4. The diffuser of claim 1 wherein the actuator means comprises screw shaft and nut elements, either of which is electrically driven and are interchangeably positioned on either the tile or the damper means.

5. The diffuser of claim 4 wherein the nut element comprises the output of a gear reduction unit mounted on either the tile means or the damper means.

6. The diffuser of claim 1 wherein the tile means is provided with a support disc affixed to the guide posts adjacent their outer ends, and a temperature or smoke sensor is mounted on said disc.

7. The diffuser of claim 6 wherein the support disc is provided with a trim disc, and the support disc and trim disc are shaped to provide in combination on enclosed chamber for containing the sensor.

8. The diffuser of claim 7 wherein spring means is provided for engaging the tile means and damper means for driving the damper means toward the port means in response to a fail safe signal.

9. The diffuser of claim 1 wherein said wall means is frusto-conical in shape and said damper means is disc shaped, said damper means thereby being tightly in contact with said wall means in its sealing or port closing position.

* * * * *